US005522965A

United States Patent [19]

Chisholm et al.

[11] Patent Number: 5,522,965

[45] Date of Patent: Jun. 4, 1996

[54] COMPACT SYSTEM AND METHOD FOR CHEMICAL-MECHANICAL POLISHING UTILIZING ENERGY COUPLED TO THE POLISHING PAD/WATER INTERFACE

[75] Inventors: Michael F. Chisholm, Plano; Andrew T. Appel, Dallas, both of Tex.

[73] Assignee: Texas Instruments Incorporated, Dallas, Tex.

[21] Appl. No.: 354,400

[22] Filed: Dec. 12, 1994

[51] Int. Cl.[6] ..... H01L 21/00

[52] U.S. Cl. ..... 156/636.1; 156/639.1; 156/345; 156/645.1; 216/89; 216/91; 437/225

[58] Field of Search ..... 156/645.1, 636.1–637.1, 156/639.1, 345, 662.1; 216/88, 89, 90, 91; 437/225; 51/262 A, 283 R, 317, 325

[56] References Cited

U.S. PATENT DOCUMENTS

| | | | |
|---|---|---|---|
| 5,232,875 | 8/1993 | Tuttle et al. | 216/88 X |
| 5,240,552 | 8/1993 | Yu et al. | 156/636.1 |
| 5,245,790 | 9/1993 | Jerbic | 51/121 |
| 5,245,796 | 9/1993 | Miller et al. | 51/283 R |

OTHER PUBLICATIONS

Robert Kolenkow, Ron Nagahara, *Cybeq Systems*, Menlo Park, California, "Chemical–Mechanical Wafer Polishing and Planarization in Batch Systems", Solid State Technology, Jun. 1992, pp. 112–114.

F. B. Kaufman, D. B. Thompson, R. E. Broadie, M. A. Jaso, W. L. Guthrie, D. J. Pearson and M. B. Small; *IBM Research Division*, Thomas J. Watson Research Center, Yorktown Heights, New York 10598 and IBM General Technology Division, Hopewell, New York 10953, "Chemical–Mechanical Polishing For Fabricating Patterned W Metal Features As Chip Interconnects".

*J. Electrochem. Soc.*, vol. 138, No. 11, Nov. 1991, The Electrochemical Society, Inc., pp. 3460–3464.

William J. Patrick, William L. Guthrie, Charles L. Standley, and Paul M. Schiable, *IBM General Technology Division*, East Fishkill Facility, Hopewell Junction, New York 12533, "Application of Chemical Mechanical Polishing to the Fabrication of VLSI Circuit Interconnections".

*J. Electrochem. Soc.*, vol. 138, No. 6, Jun. 1991, The Electrochemical Society, Inc., pp. 1778–1784.

*Primary Examiner*—William Powell

*Attorney, Agent, or Firm*—Jacqueline J. Garner; Jim Brady; Richard L. Donaldson

[57] ABSTRACT

A compact system and method for chemical-mechanical polishing. A polishing pad (114) is attached to a non-rotating platen (112) and used to polish a wafer (116). Rotating arm (118) positions the wafer (116) over the pad (114) and applies pressure. Energy (e.g. ultrasonic) is coupled from device (122) to the platen (112). Energy is thus applied to the pad/wafer interface to aid in the removal of surface material from wafer (116) and for pad conditioning. New slurry is added to wash the particles off the edges of the pad (114).

21 Claims, 2 Drawing Sheets

COMPACT SYSTEM AND METHOD FOR CHEMICAL-MECHANICAL POLISHING UTILIZING ENERGY COUPLED TO THE POLISHING PAD/WATER INTERFACE

CROSS-REFERENCE TO RELATED APPLICATIONS

The following co-assigned patent application is hereby incorporated herein by reference:

| Serial No. | Filing Date | Inventor |
|---|---|---|
| 08/209,816 | 03/11/94 | Chisholm et. al. |

FIELD OF THE INVENTION

This invention generally relates to semiconductor processing and more specifically to chemical-mechanical polishing (CMP).

BACKGROUND OF THE INVENTION

As circuit dimensions shrink the need for fine-line lithography becomes more critical and the requirements for planarizing topography becomes very severe. Major U.S. semiconductor companies are actively pursuing Chemical-Mechanical Polishing (CMP) as the planarization technique used in the sub-half micron generation of chips. CMP is used for planarizing bare silicon wafers, interlevel dielectrics, and other materials. CMP machines, such as the one shown in FIG. 1, use orbital, circular, lapping motions. The wafer 16 is held on a rotating carrier 18 while the face of the wafer 16 being polished is pressed against a resilient polishing pad 14 attached to a rotating platen disk 12. A slurry is used to chemically attack the wafer surface to make the surface more easily removed by mechanical abrasion. Pad conditioning is done by mechanical abrasion of the pads 14 in order to 'renew' the surface. During the polishing process, particles removed from the surface of the wafer 16 become embedded in the pores of the polishing pad 14 and must be removed. Current techniques use a conditioning head 22 with abrasive diamond studs to mechanically abrade the pad 14 and remove particles. Conditioning arm 24 positions condition head 22 over polishing pad 14.

Current chemical-mechanical polishing tools are physically large machines. Because of the low throughput of single wafer tools, the trend is toward multiple wafer tools. Current multiple wafer tools simply increase the number of polishing heads to match the number of wafers polished per run. This requires enormously complex robot and wafer carrier assemblies and substantial floor space. Multiple wafer tools, polishing 2–6 wafers per run, require matching of the multiple polishing heads to achieve good wafer-to-wafer uniformity. Furthermore, because the platen is rotating and the center of the pad has zero velocity, the wafer must be kept off-center from the platen for good uniformity. Accordingly, the platen itself must be much larger than the wafers being polished. Multiple wafer tools are thus very space consuming and can weigh in excess of 3 tons (2,700 Kg).

SUMMARY OF THE INVENTION

A compact system and method for chemical mechanical polishing using energy coupled to the polishing pad/wafer interface is disclosed. A slurry is provided over the surface of a polishing pad and polishing platen. A rotating wafer is brought in contact with the non-rotating polishing pad. Energy (e.g., ultrasonic energy) is introduced to the system to aid in the removal of material from the surface of the wafer and for polishing pad conditioning. In one embodiment, ultrasonic energy is coupled directly to the polishing platen.

An advantage of the invention is providing a method and apparatus for chemical-mechanical polishing that uses energy coupled to either the polishing pad or wafer holder.

A further advantage of the invention is providing a chemical-mechanical polisher having a smaller footprint so as to allow cluster configurations.

A further advantage of the invention is providing a chemical-mechanical polisher having decreased mechanical complexity.

These and other advantages will be apparent to those of ordinary skill in the art having reference to this specification in conjunction with the drawings.

BRIEF DESCRIPTION OF THE DRAWINGS

In the drawings.

Corresponding numerals and symbols in the different figures refer to corresponding parts unless otherwise indicated.

DETAILED DESCRIPTION

CMP involves both chemical and mechanical abrasion. Chemical abrasion is accomplished using a slurry to chemically weaken the surface of a wafer. Mechanical abrasion is accomplished using a polishing pad against which a wafer surface is pressed. Conventionally, both the polishing pad and the wafer are rotated to cause the removal of surface material. The removed material is then washed over the edges of the polishing pads and into a drain by adding additional slurry. CMP planarization produces a smooth, damage-free surface for subsequent device processing. It requires less steps than a deposition/etchback planarization and has good removal selectivity and rate control. For silicon dioxide, removal rates on the order of 60–80 nm/min for a thermal oxide and 100–150 nm/min for an LPCVD (low pressure chemical-vapor deposition) oxide can be achieved.

Figure 1:
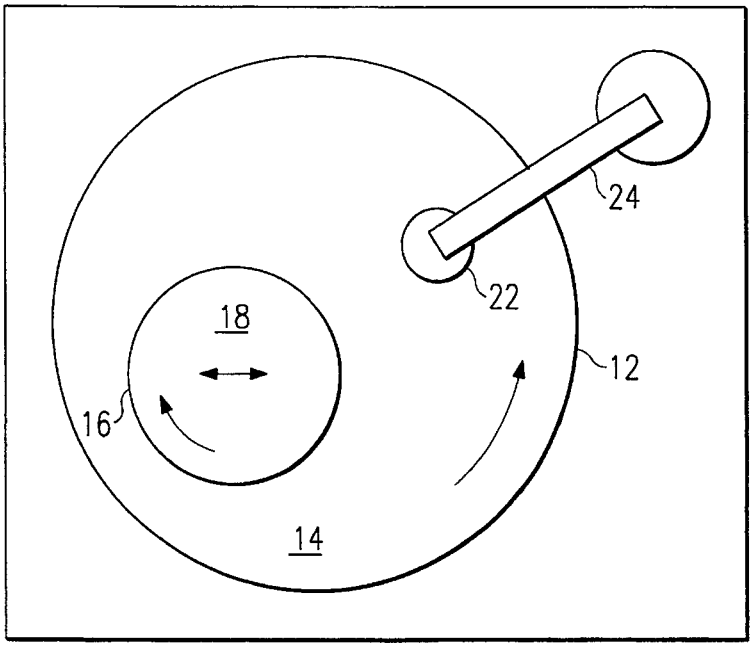
FIG. 1 PRIOR ART
FIG. 1 is a top view of a prior art CMP machine.
Figure 2:
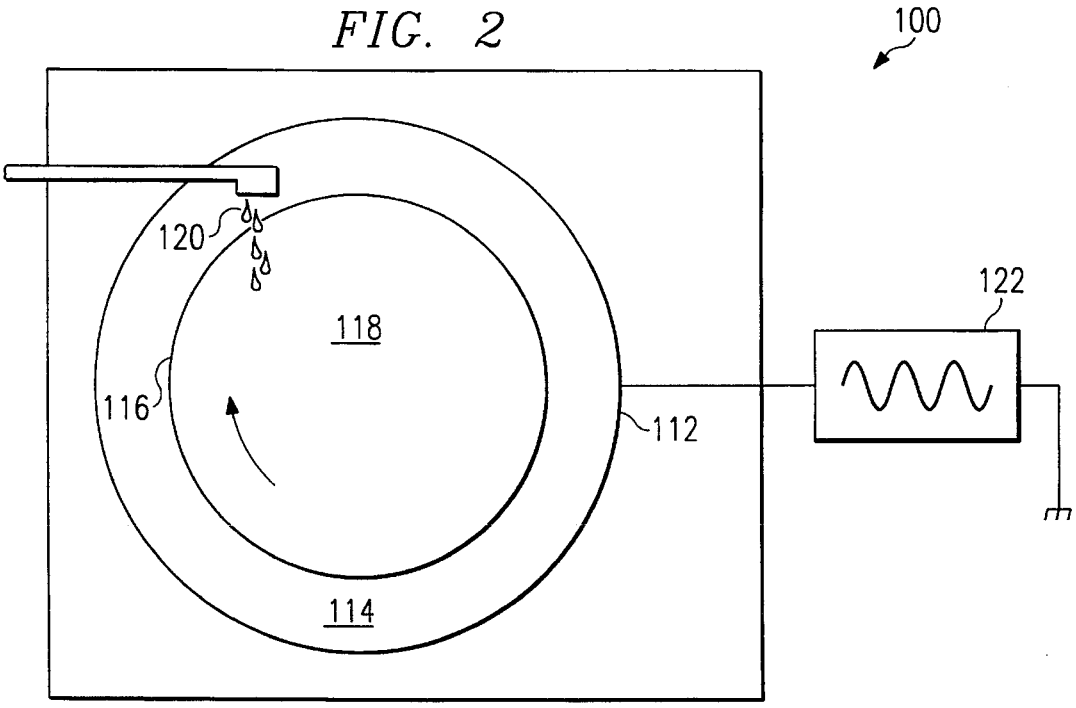
FIG. 2 is a top view of a CMP machine according to the invention.
Figure 3:
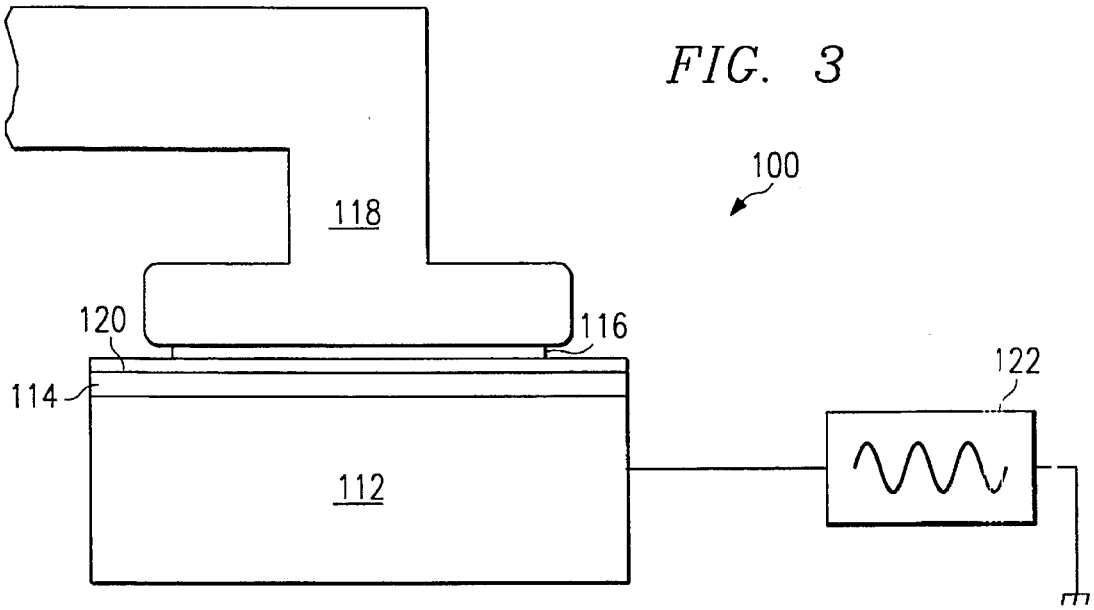
FIG. 3 is a cross-sectional view of a CMP machine according to the invention.

A preferred embodiment of the invention is shown in FIGS. 2 and 3. CMP machine 100 contains a polishing pad 114 secured to a platen 112. Polishing pad 114 typically comprises polyurethane. However, it will be apparent to those skilled in the art that other materials such as those used to make pads for glass polishing, may be used. In addition, the hardness of polishing pads 114 may vary depending on the application. Platen 112 is not operable to rotate during polishing in contrast to prior art techniques. The velocity at the center of a rotating platen is zero so the wafer needed to be placed off-center in prior art designs. In contrast, platen 112 does not rotate. Accordingly, the size of platen 112 is much smaller than in prior art designs because there is no longer a requirement to place the wafer off-center. Platen 112 may have a diameter on the order of 12 to 15 in. versus 22 to 24 in. as in the prior art.

Rotating carrier 118 is operable to position wafer 116 on polishing pad 114 and apply force to press the wafer 116 against polishing pad 114. Rotating carrier 118 may position a single wafer 116 or several wafers or there may be more than one rotating carrier 118. Several methods of attaching a wafer to rotating carrier 118 are known in the art. For example, the wafer 116 may be bonded to the rotating carrier 118 by a thin layer of hot wax. Alternatively, a poromeric film may be placed on the bottom of the rotating carrier 118. The bottom of rotating carrier 118 would then have a recess (or recesses) for holding the wafer 116. When the poromeric film is wet, the wafer is kept in place by surface tension. Rotating carder 118 is operable to rotate the wafer 116 against platen 112. If desired, rotating carder 118 may also be able to move wafer 116 laterally, in an arc, or in a FIG. 8 pattern over pad 114 for better uniformity.

A slurry 120 covers polishing pad 114. A typical slurry for interlevel dielectric planarization comprises silicon dioxide in a basic solution such as KOH (potassium hydroxide) which is diluted with water. However, other slurry compositions will be apparent to those skilled in the art.

Device 122 is connected to a platen 112 for coupling energy to platen 112. Device 122 may comprise an ultrasonic transducer which directs ultrasonic energy through platen 112 to the wafer 116/slurry 120/polishing pad 114 interface. Ultrasonic devices, such as device 122, are in wide use in the semiconductor industry as wafer cleaners. Accordingly, the use of ultrasonic energy in the preferred embodiment is very compatible with current wafer fabrication and thus would not be harmful to the resulting product and not meet resistance to implementation. Other frequencies and/or mixed frequencies may alternatively be used for device 122.

In contrast to prior art designs, a separate pad conditioner and associated positioning arm are not required. Pad 114 conditioning is accomplished through the coupled energy from device 122. Thus, CMP machine 100 is less mechanically complex than prior art designs. In addition, platen 112 does not need to be large enough to accommodate both a pad conditioner and wafer 116.

In operation, the wafer 116 is rotated at a constant angular velocity and energy is coupled to polishing platen 112 by device 122. The energy coupled to platen 112 may be sufficient to cause polishing pad 114 to vibrate. Vibration preferably occurs at the atomic to macroscopic level. Slurry 120 is continuously added to the surface of pad 114 causing used slurry to drain over the edges of the pad 114. Particles are removed from the wafer by the chemical abrasives in the slurry 120, the mechanical abrasion of the polishing pad 114, and the vibration of polishing pad 114 caused by energy from device 122. As a result, planarization and/or selective removal of material is accomplished. Since it is likely that the wafer surface removal mechanism will depend less on physical shear-force polishing, the down force of the wafer 116 to the polishing pad 114 should be able to be decreased while maintaining polishing rate.

Tuning the energy to a vibrational harmonic of the silicon-oxide band (e.g. on the order of 33 THz) may enhance the polishing rate for a silicon-dioxide film. Tuning the vibrational harmonic excites the silicon-dioxide layer without raising the overall wafer temperatures. The excited silicon-dioxide bonds are more prone to breaking which, in turn, enhances the polish rate.

Particles removed from the wafer 116 as well as particles from the slurry 120 may attempt to become embedded in the polishing pad 114. However, the energy applied to the platen 112 should prevent this from occurring. The particles become suspended in the slurry 120 and are washed over the edge of polishing pad 114 as new slurry is added. Accordingly, additional pad conditioning is not required.

Slurry 120 acts as a conductor to couple the energy between polishing pad 114 and wafer 116. This energy causes vibration in the slurry 120 and polishing pad 114. The vibration aides in the removal of material from the surface of wafer 116 and causes the particles which would ordinarily become embedded in polishing pad 114 to be removed from the pad 114 into the slurry 120. Then, as additional slurry 120 is added, the spent slurry 120 containing the removed particles is rinsed over the edges of polishing pad 114 into a drain (not shown). Removing the particles from the polishing pad 114 prevents the pad surface from depleting and glazing due to particles becoming embedded in the pores of pad 114. Moreover, this energetic action will not physically wear the pad, such as current pad conditioning techniques do, thus extending the life of the polishing pad.

If desired, a center-to-edge gradient may be imposed on the platen 112 under the rotating carrier 118. This enables tailoring of the wafer polishing profile. For example, if a higher polishing rate were desired near the center of the wafer, the energy coupled to the center of polishing platen 112 would be increased relative to the energy coupled nearer the edge of polishing platen 112.

Figure 4:
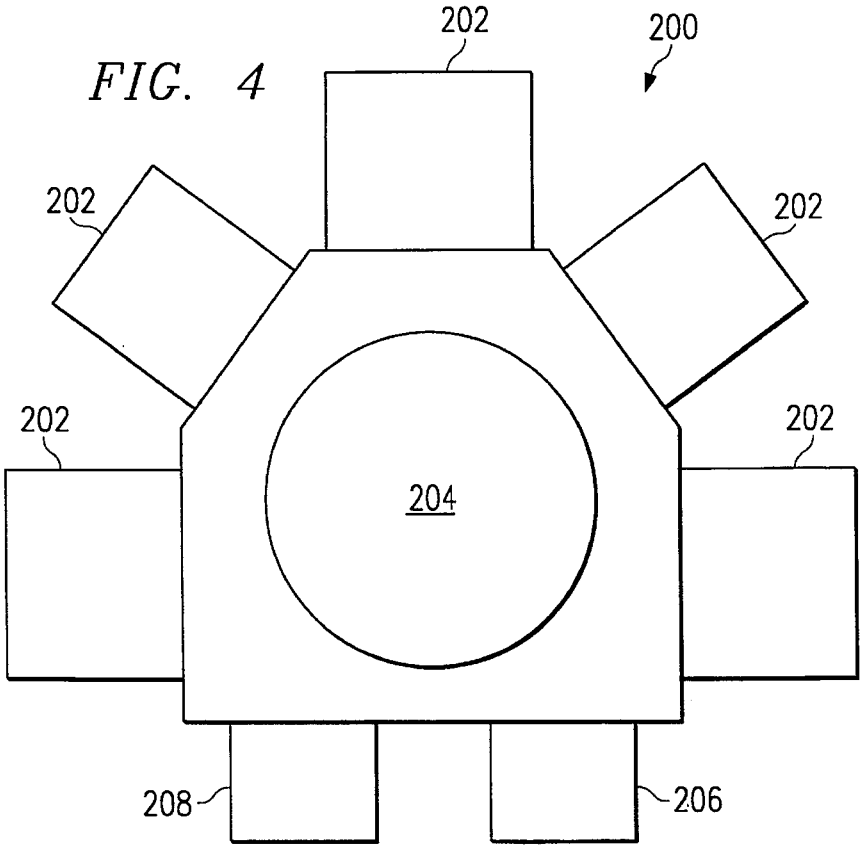
FIG. 4 is a top view of a clusterable CMP machine according to the invention.

A clusterable CMP machine 200 is shown in FIG. 4. Multiple CMP heads 202 are placed around a central robot handler 204. Each CMP head 202 includes a polishing platen, polishing pad, and rotating carrier as shown in FIGS. 2 and 3 and described above. Each CMP head 202 may also have its own energy device, such as device 122 or several CMP heads 202 may share an energy device such as device 122. Central robot handler 204 transfers wafers from the wafer receive area 206 to one of the CMP heads 202 for polishing and from a CMP head 202 to the wafer send area 208 once polishing is complete.

The reduction in platen size and polisher complexity enables a single-wafer module such as CMP head 202 to be more feasible. A single wafer module such as CMP head 202 coupled to a central robot handler 204 provides the flexibility of having incremental throughput improvements on a given platform by adding additional CMP heads 202. In addition, deposition and polish could be provided on the same platform.

While this invention has been described with reference to illustrative embodiments, this description is not intended to be construed in a limiting sense. Various modifications and combinations of the illustrative embodiments, as well as other embodiments of the invention, such as coupling the energy directly to the wafer and rotating wafer carrier instead of to the platen, will be apparent to persons skilled in the art upon reference to the description. It is therefore intended that the appended claims encompass any such modifications or embodiments.

What is claimed is:

1. A method for chemical-mechanical polishing comprising the steps of:

a. applying a slurry over a surface of a non-rotating polishing pad;

b. pressing a wafer against the surface of the polishing pad;

c. rotating said wafer during said pressing step to remove material from a surface of the wafer; and d. coupling energy to an interface between said wafer and said polishing pad to aid in the removal of said material from the surface of the wafer.

2. The method of claim 1, wherein said coupling energy step causes said polishing pad to vibrate.

3. The method of claim 1, wherein said coupling energy step couples energy from an energy source to a platen that supports said polishing pad.

4. The method of claim 3, wherein said coupling energy step provides an energy gradient from the center of said platen to the edge of said platen.

5. The method of claim 1, wherein said coupling energy step couples energy from an energy source to said wafer.

6. The method of claim 1, wherein said coupling energy step inhibits said material from becoming embedded in said polishing pad.

7. The method of claim 1, wherein said coupling energy step couples ultrasonic energy to the interface between said wafer and said polishing pad.

8. The method of claim 1, wherein said coupling energy step couples mixed frequency energy to the interface between said wafer and said polishing pad.

9. The method of claim I wherein said energy is tuned to a vibrational harmonic of the silicon-oxide bond.

10. A chemical-mechanical polishing system, comprising:

a. a polishing pad;

b. a non-rotating platen for supporting said polishing pad;

c. a wafer carrier for rotating a wafer against said polishing pad; and d. an energy device for supplying energy to an interface between said polishing pad and the wafer.

11. The chemical-mechanical polishing system of claim 10, wherein said energy device is coupled to said platen.

12. The chemical-mechanical polishing system of claim 10, wherein said energy device is coupled to the wafer.

13. The chemical-mechanical polishing system of claim 10, wherein said energy device is an ultrasonic transducer.

14. The chemical-mechanical polishing system of claim 10, wherein said energy device is a mixed frequency energy device.

15. A chemical-mechanical polishing system having energy coupled to at least one polishing platen.

16. The chemical-mechanical polishing system of claim 15, further comprising:

e. a polishing pad supported by said at least one non-rotating polishing platen;

f. a wafer carrier for rotating a wafer against said polishing pad; and g. an energy device for supplying said energy to an interface between said polishing pad and the wafer.

17. The chemical-mechanical polishing system of claim 15, wherein said energy device is an ultrasonic transducer.

18. The chemical-mechanical polishing system of claim 15, wherein said energy device is a mixed frequency energy device.

19. The chemical-mechanical polishing system of claim 15, further comprising:

a. a plurality of chemical-mechanical polishing heads, each of said chemical mechanical polishing heads comprising:

i. one of said at least one polishing platens;

ii. a polishing pad supported by said one of said at least one polishing platens; and iii. a wafer carrier for rotating a wafer against said polishing pad; and b. a robot handler for transferring a wafer from a wafer receive region to one of said chemical-mechanical polishing heads for polishing and from one of said chemical-mechanical polishing heads to a wafer send region.

20. The chemical-mechanical polishing system of claim 19, further comprising an energy device for coupling energy to each of said at least one polishing platens.

21. The chemical-mechanical polishing system of claim 19, wherein each of said chemical-mechanical polishing heads further comprises an energy device for coupling said energy to said one of said at least one polishing platens.

* * * * *